US006430893B1

(12) United States Patent
Kindon

(10) Patent No.: US 6,430,893 B1
(45) Date of Patent: Aug. 13, 2002

(54) GLAZING PANEL

(76) Inventor: Rodney Kindon, 51 Tweedsmair Close, Cinnamon Brow, Warrington, WA2 OEL Cheshire (GB)

( * ) Notice: Subject to any disclaimer, the term of this patent is extended or adjusted under 35 U.S.C. 154(b) by 0 days.

(21) Appl. No.: 09/536,156

(22) Filed: Mar. 28, 2000

(30) Foreign Application Priority Data

May 22, 1999 (GB) ..... 9911903
Dec. 15, 1999 (EP) ..... 99310092

(51) Int. Cl.[7] ..... E04C 2/54
(52) U.S. Cl. ..... 52/786.1; 52/745.2
(58) Field of Search ..... 52/172, 786.1, 52/786.13, 745.2, 801.1, 204.7, 204.62, 204.63, 235; 411/84, 85

(56) References Cited

U.S. PATENT DOCUMENTS

D294,676 S * 3/1988 Egner ..... D8/387
5,163,257 A * 11/1992 Crowell ..... 52/200
5,546,713 A * 8/1996 Voegele, Jr. et al. ..... 52/202
6,082,071 A * 7/2000 Richardson ..... 52/718.04

FOREIGN PATENT DOCUMENTS

| | | |
|---|---|---|
| EP | 0473321 | 3/1992 |
| FR | 2495999 | 6/1982 |
| WO | 96/10119 | 4/1996 |

* cited by examiner

*Primary Examiner*—Carl D. Friedman
*Assistant Examiner*—Kevin McDermott
(74) *Attorney, Agent, or Firm*—Dennison, Schultz & Dougherty

(57) ABSTRACT

A multi-walled glazing panel which is to be attached at either side thereof to a support structure. The panel includes a plurality of horizontal sheet members separated from one another by vertical interconnecting walls which define channels along the length of the panel. A reinforcing member is disposed in the channel adjacent the side which is to be attached to the support member.

17 Claims, 8 Drawing Sheets

GLAZING PANEL

FIELD OF THE INVENTION

The present invention relates to a glazing panel. More particularly, the present invention relates to a multi-walled glazing panel suitable for use as a roof light or like structure. The present invention also provides a method of attaching a multi-walled glazing panel to a support structure.

BACKGROUND OF THE INVENTION

The provision of roof lighting enables daylight to be effectively transmitted or admitted into buildings.

One type of roof lighting includes at least one multi-walled glazing panel supported by a support structure, which is locatable on the roof of a building. Such support structures generally comprise a plurality of bar members located at either side of the multi-walled glazing panel and which are adapted to receive such panels. Such bar members are commonly referred to in the industry as glazing bars and come in various shapes and sizes. It is to be understood that such panels can be located on any part of a building or like structure.

With reference to FIG. 1, which is a perspective view of a known multi-walled glazing panel, a known type of multi-walled glazing panel 100 includes a plurality of, or at least two, horizontal sheet members 101, separated from one another by vertical interconnecting walls 102, such walls 102 defining channels 103 running along the length of the multi-walled glazing panel 100. Generally, multi-walled glazing panels 100 of this type are made from the extrusion of a polycarbonate material, and the thickness of such panels can range from 4 millimeters up to approximately 30 millimeters.

A major advantage of this type of multi-walled glazing panel is that they provide good heat insulation and light transmission and consequently, can assist with savings in energy costs. Moreover, and as such glazing panels are extremely light in weight, less stress is exerted by them on the surrounding structures of the building to which they are attached and consequently, it is believed that they may actually extend the life of a building to which they are attached.

However, and somewhat surprisingly, such panels may become dislodged from their respective support structures if a heavy object falls on top of same. This is somewhat surprising as polycarbonate has exceptional levels of impact and shock resistance. In this connection, it is believed that due to the flexible nature of multi-walled polycarbonate glazing panels of this type, when a heavy object falls onto same, they flex in an elastic manner such that the sides of same come free from the glazing bars of the support structure supporting same. This has severe safety implications, especially if the heavy object concerned is a person.

SUMMARY OF THE PRESENT INVENTION

According to an aspect of the present invention there is provided a multi-walled glazing panel which, in use, is attached at either side thereof to a support structure, the multi-walled glazing panel including a plurality of horizontal sheet members separated from one another by vertical interconnecting walls, such vertical interconnecting walls defining channels running along the length of the multi-walled glazing panel characterised in that the sides of the multi-walled glazing panel that are attachable to the support structure are reinforced.

It is believed that the present invention addresses the problem outlined above. In particular, and as the sides of the multi-walled glazing panel of the present invention, which are to be attached to the support structure, are reinforced, same is less likely to come free from the support structure when an object falls thereon. Therefore, it is believed that the present invention increases the overall safety of using such multi-walled glazing panels as part of a roof light or like structure. In this connection, it is believed that by reinforcing the sides, same acts as a mechanical restraint and moreover, enhances the inherent rigidity of the multi-walled glazing panel, thereby increasing the resistance to the dislocation of the glazing panel from the support structure. Furthermore, it is believed that both of the above factors result in a high percentage of the energy of the falling object being transferred to, and absorbed by, the support structure, which can safely absorb such energy without the dislodgment of the glazing panel therefrom.

In a preferred embodiment, the sides of the multi-walled glazing panel which are attachable to the support structure are reinforced with reinforcement means which are locatable within the multi-walled glazing panel.

In a preferred embodiment, the reinforcement means comprises a bar of metal, preferably extruded commercial grade aluminium. It is to be understood that the bar may be of any other suitable material exhibiting the desired rigidity, for example, polycarbonate.

Preferably, the reinforcement means is sized to fit snugly within a channel provided within the multi-walled glazing panel, but not too snugly so that same is difficult to insert into said channel. This has the advantage in that same is easy to locate within the glazing panel.

Further preferably, the reinforcement means is of such a size that it is concealed by the portion of the support structure to which it is fixed. This has the advantage in that the reinforcement means cannot be seen from either above or below and hence, does not affect the aesthetic qualities of the glazing panel, nor hinder the transmission of light therethrough.

In a further aspect of the present invention there is provided a roof light incorporating a multi-walled glazing panel in accordance with the present invention.

In a further aspect of the present invention there is provided a method of attaching the sides of a multi-walled glazing panel which includes a plurality of horizontal sheet members separated from one another by vertical interconnecting walls, such vertical interconnecting walls defining channels running along the length of the multi-walled glazing panel, the method comprising the steps of.

inserting at least one reinforcement means into at least one channel located at either side of the multi-walled glazing panel; and attaching the multi-walled glazing panel to a support structure.

DETAILED DESCRIPTION OF THE PREFERRED EMBODIMENTS

Figure 1:
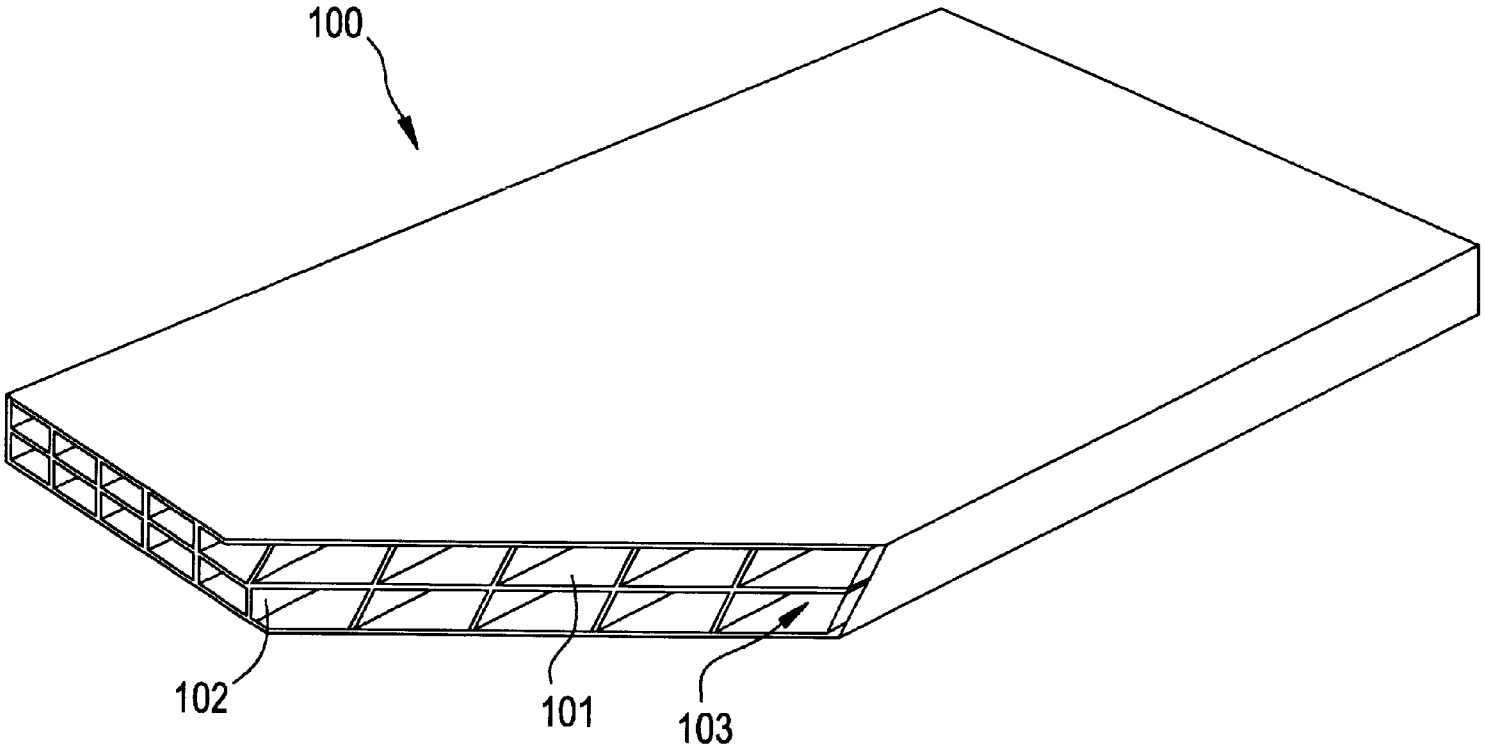
FIG. 1 PRIOR ART
FIG. 1 is a perspective view of a prior art multi-walled glazing panel.
Figure 2:
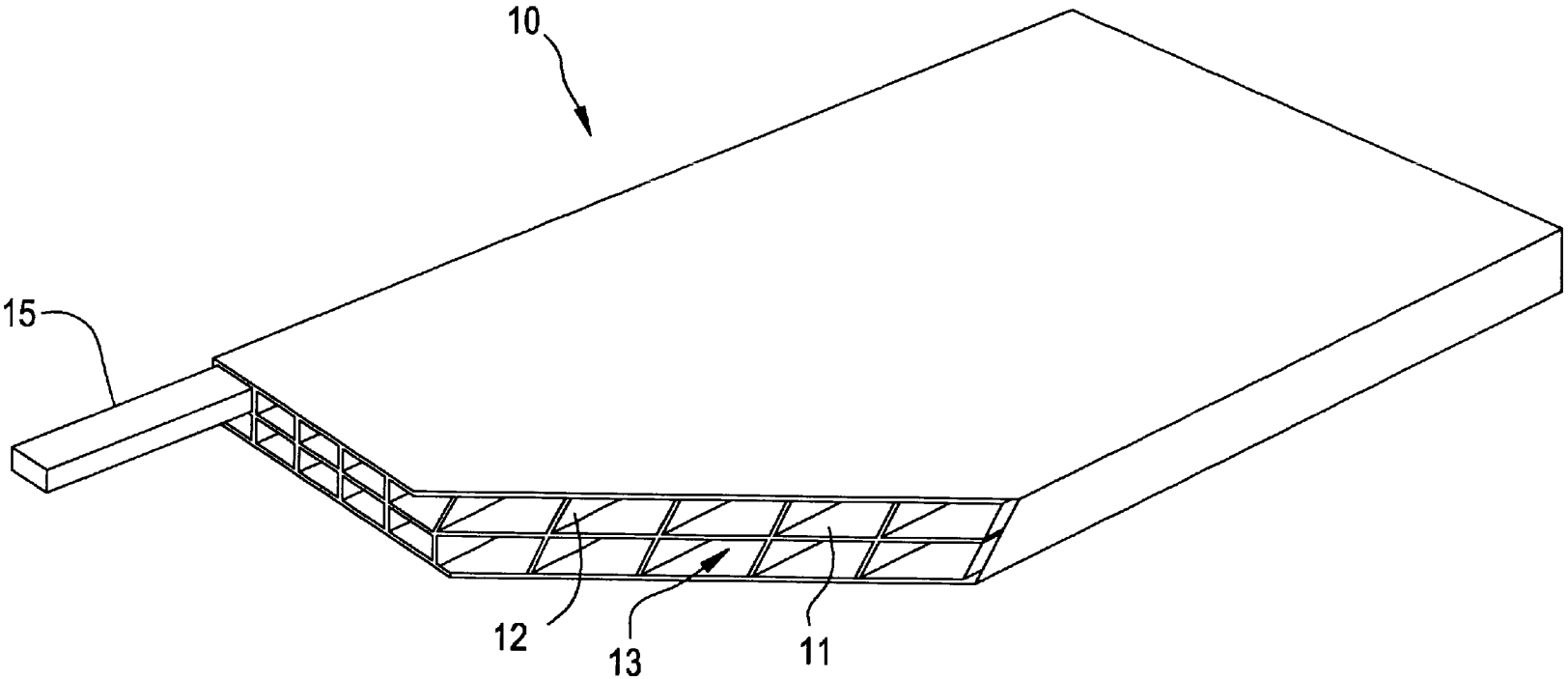
FIG. 2 is a perspective view of a first embodiment of a multi-walled glazing panel in accordance with the present invention.

As illustrated in FIG. 2, a multi-walled polycarbonate glazing panel 10 in accordance with the present invention includes a plurality of horizontal sheet members 11, separated from one another by vertical interconnecting walls 12, such walls 12 defining channels 13 running the length of the multi-walled glazing panel 10. Additionally, and in order to reinforce the sides or side portions of the panel 10 which are to be attached or supported by a support structure, such as a glazing bar, same is further provided with reinforcement bars 15 which are insertable into channels 13 located at either side of the panel 10. For illustration purposes, only one of such bars 15 is shown in FIG. 2.

Figure 3:
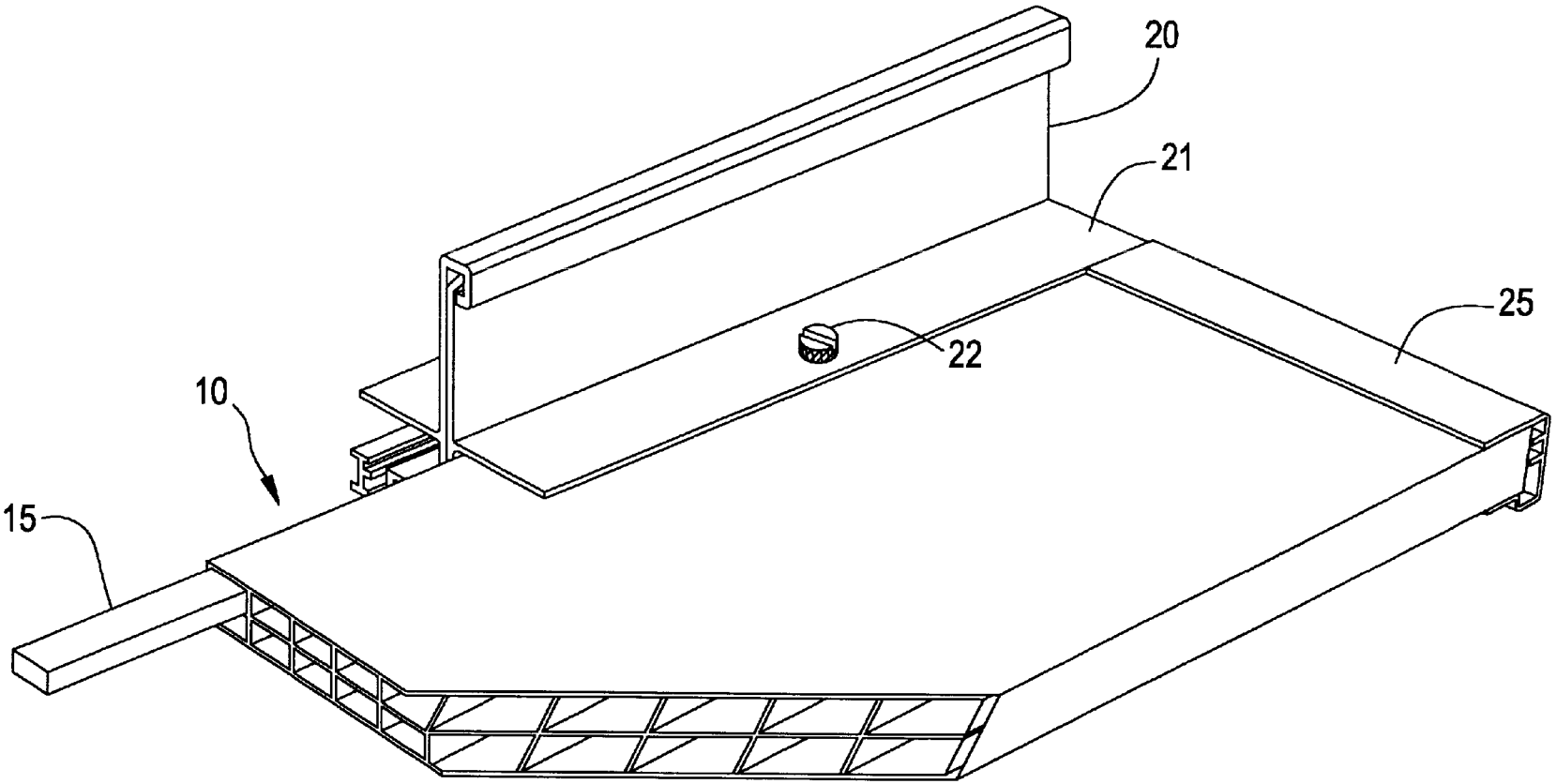
FIG. 3 illustrates the glazing panel of FIG. 2 when fixed to a glazing bar of the interlocking type.
Figure 4:
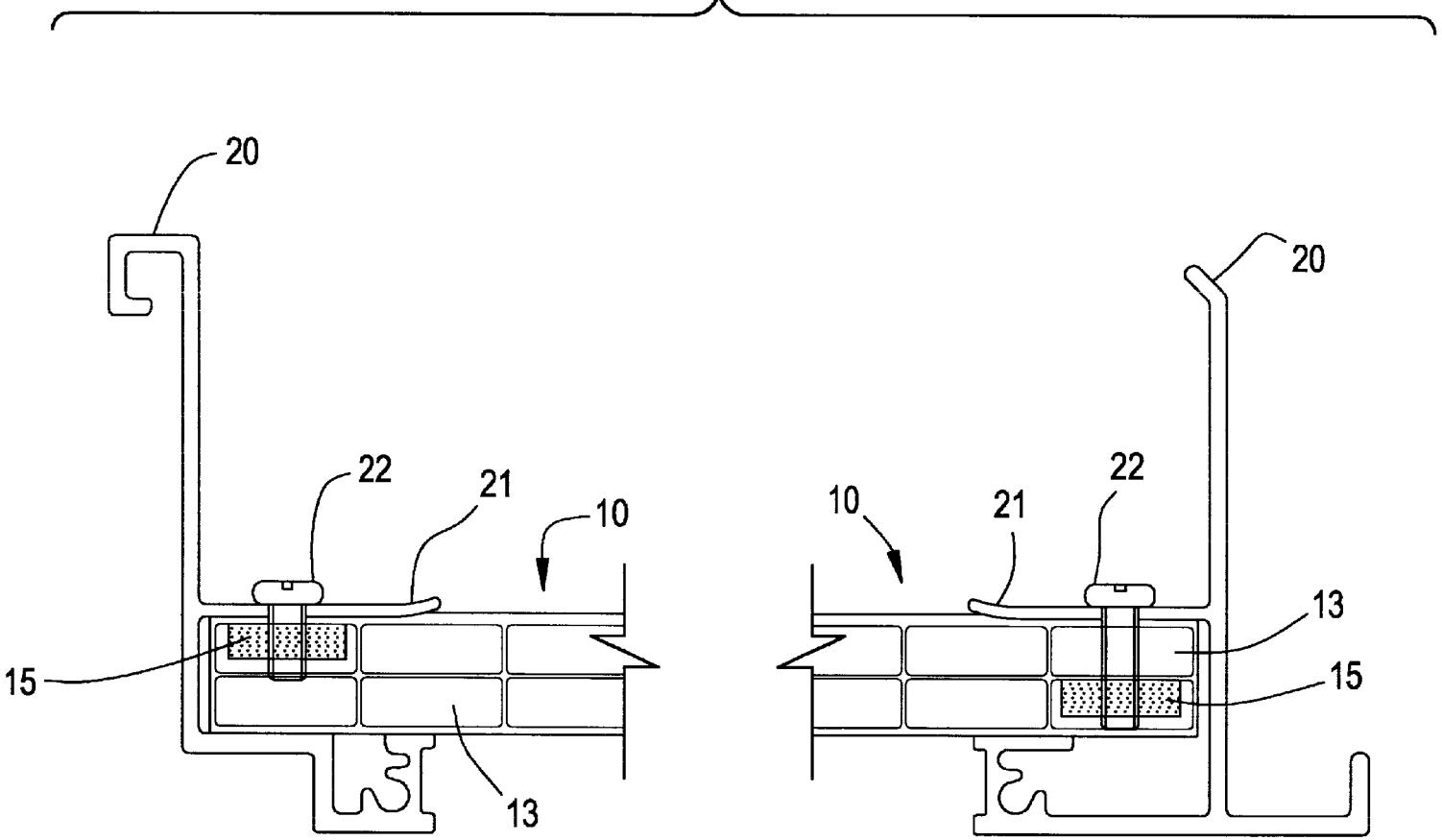
FIG. 4 is a cross-sectional view of a multi-walled glazing panel of FIG. 2 when fixed to the glazing bar of FIG. 3.

As illustrated in FIGS. 3 and 4, each side of the panel 10 is locatable between the jaw or clamp portion 21 of a glazing bar 20 of the interlocking type, sold by us under the name "MULTI-LINK-PANEL INTERLOCKING MODULAR GLAZING SYSTEM", which is the subject of our European Patent No. 0473321. As shown, the panel 10 and reinforcement bars 15 are fixed to the glazing bar 20 via fixing means 22, such as a self tapping screw, which passes through an aperture provided in a surface of the jaw 21 into the panel 10 and reinforcement bar 15. As shown in FIG. 4, the bar 15 can be located in either of the channels 13 directly adjacent the glazing bar 20. Additionally, the bar 15 is located within the confines of the jaw 21 of the glazing bar 20 and hence, is concealed. Once each side of the glazing panel 10 is fixed to its respective glazing bar 20, via reinforcement bars 15, a U-profile capping member 25 is placed on either end of the glazing panel 10.

In order to install a multi-walled polycarbonate glazing panel 10 as shown in FIGS. 2 and 3, a reinforcement bar 15 is inserted into a channel 13 at each side of the panel 10 which are to be fixed to the glazing bars 20 of a support structure. It is preferable that the length of the reinforcement bar 15 is selected such that when located within the glazing panel 10, same protrudes at both ends thereof, preferably by about 4 mm.

Once the bar 15 is in position, a clearance hole or aperture is provided through the top of each jaw 21 and through the top layer of the glazing panel 10, followed by a tapping hole through the reinforcement bar 15. Such an aperture is preferably provided on both sides of the glazing panel 10 in a central position along the length of each glazing bar 20 and immediately over the center of the reinforcement bar 15. Fixing means 22, such as a self tapping screw, is then driven into the assembly of the glazing bar 20, panel 10 and reinforcement bar 15, until the head of the screw 22 sits on the surface of the glazing bar 20. Preferably, such screw 22 is not tightened to such an extent that free thermal movement of the glazing panel 10 is hindered, that is, when fixed to its respective glazing bar 20.

If applicable, U-profile capping members 25 are then placed at either end of the glazing panel 10. The protrusion of the reinforcement bar 15 beyond the end of the panel 10 is intended to act as a restraint by contact with the U-profile capping members 25, thus preventing any sideways movement of the reinforcement bar 15.

Figure 5:
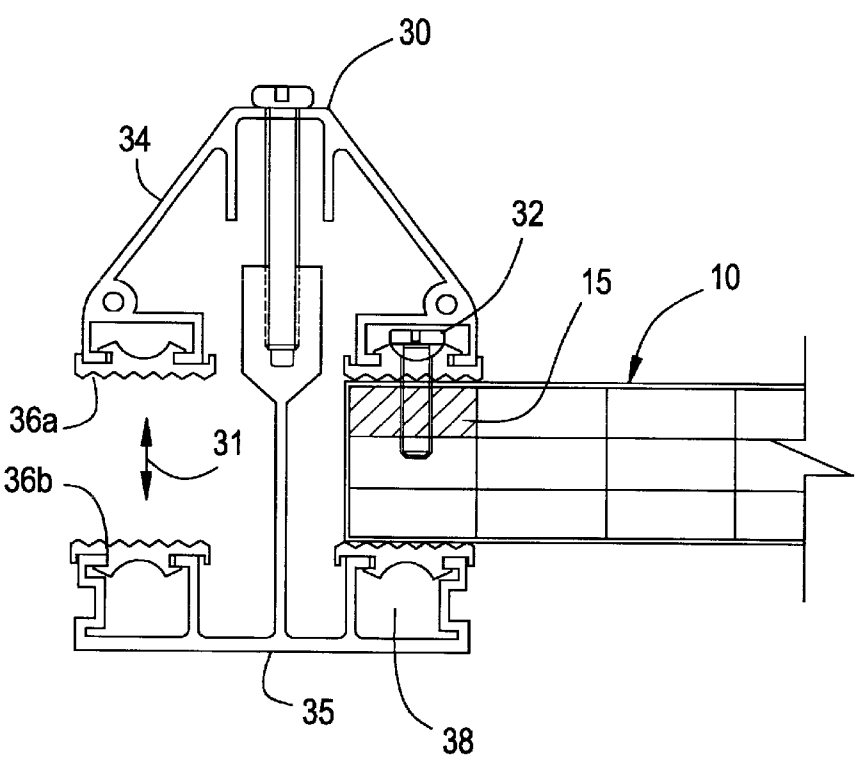
FIG. 5 is a cross-sectional view of a multi-walled glazing panel of FIG. 2 when fixed to a "conventional" type glazing bar.

As illustrated in FIG. 5, a side of the panel 10 is locatable between a jaw or Clamp portion 31 provided by a base member 35 and capping bar 34 of a glazing bar 30. As shown, the panel 10 and reinforcement bar 15 are fixed to the glazing bar 30 via fixing means 32, such as a self-tapping screw, which passes through an aperture provided in a surface of a upper seal 36*a* into the panel 10 and reinforcement bar 15. As shown in FIG. 5, the bar 15 is located in the uppermost channel 13 provided within the panel 10, however, it is understood that it can be provided in any of the channels 13. Additionally, the bar 15 is located within the confines of the jaw 31 provided by the base member 35 and capping bar 34 of the glazing bar 30 and hence, is concealed. Although not illustrated, once fixed to the glazing bar 30, each end of the glazing panel 10 can be provided with a U-profile capping member.

In order to install a multi-walled polycarbonate glazing panel 10 in accordance with the present invention to a glazing bar 30 as shown in FIG. 5, a reinforcement bar 15 is inserted into a channel at each side of the panel 10 which is to be fixed to the glazing bar 30 of a support structure. Preferably, the length of the reinforcement bar 15 is selected such that, when located within the glazing panel 10, same protrudes at both ends thereof, preferably by about 4 mm.

Once the bar 15 is in position, a clearance hole or aperture is provided through the top of the seal 36*a* and through the top layer of the glazing panel 10, followed by a tapping hole through the reinforcement bar 15. Such an aperture is preferably provided on both sides of the glazing panel 10 in a central portion along the length of each glazing bar 30 and immediately over the centre of the reinforcement bar 15. Fixing means 32, such as a selftapping screw, is then driven into the assembly of the seal 36*a,* panel 10 and reinforcement bar 15.

If applicable, U-profile capping members are then placed at either end of the glazing panel 10 The protrusion of the reinforcement bar 15 beyond the ends of the panel 10 is intended to act as a restraint by contact with the U-profile capping member, thus preventing any sideway movements of the reinforcement bar 15.

Figure 6:
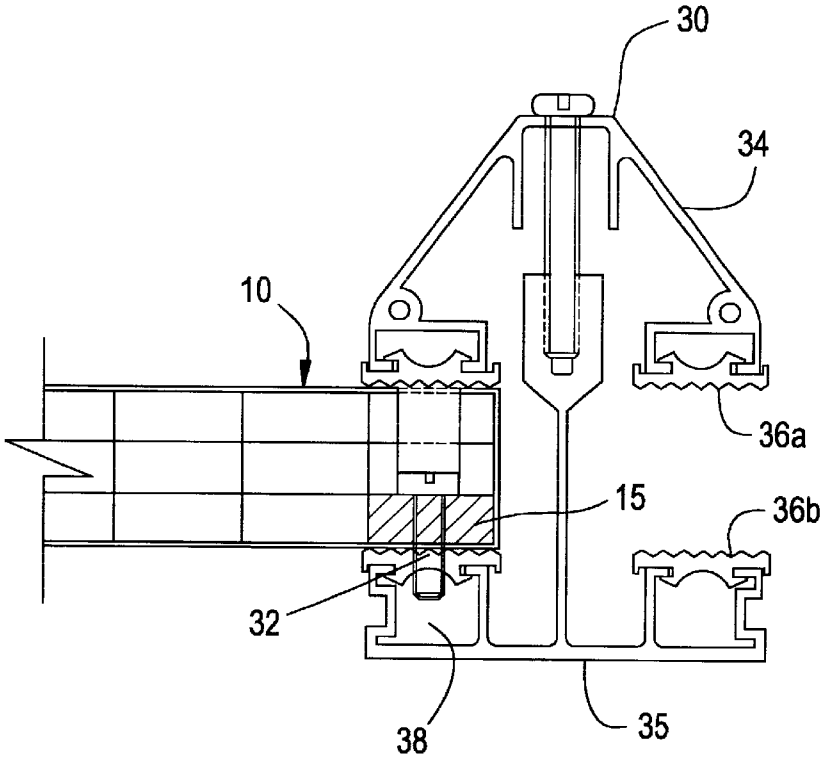
FIG. 6 is a cross-sectional view of a multi-walled glazing panel of FIG. 2 when attached to a first embodiment of a "conventional" type glazing bar.

As illustrated in FIG. 6, each side of the panel 10 is locatable between the jaw or clamp portion 31 provided by a base member 35 and a capping bar 34 of a glazing bar 30. As shown, the panel 10 and reinforcement bar 15 are fixed to one another via fixing means 32, such as a self-tapping screw. As illustrated, one end 32*a* of fixing means 32 protrudes into space 38 provided by base member 35 of the glazing bar 30. In the illustrated embodiment, same passes through a lower seal 36b provided on the base member 35 of the glazing bar 30. As the fixing means 32 protrudes into the space 38, when the glazing panel 10 is hit by an object, this causes the end 32*a* of the fixing means 32 to engage with a surface of the base member 35 and hence, prevents the glazing panel 10 from being removed or dislodged from the glazing bar 30.

With reference to FIG. 6, although the reinforcement bar is located in the lowermost channel 13, it is to be understood that it can be located in any of the channels 13 adjacent the glazing bar 30. In this connection, it is only the length of the fixing means which must be long enough to engage with a surface of the glazing bar 30. For the avoidance of any doubt, such surface may be provided by the base member 35 or capping bar 34 of glazing bar 30.

Additionally, the reinforcement bar 15 is located within the confines of the jaw 31 provided by the base member 35 and capping bar 34 of the glazing bar 30 and hence, is concealed. Although not illustrated, once fixed to the glazing bars 30, each end of the glazing panel 10 may be provided with a U-profile capping member.

In order to attach a multi-walled polycarbonate glazing panel 10 in accordance with the present invention to a glazing bar 30 as shown in FIG. 6, a reinforcement bar 15 is inserted into a channel 13 at each side of the panel which are to be attached to the glazing bars 30 of the support structure. It is preferable, that the lengths of the reinforcement bar 15 is selected such that when located within the glazing panel 10, same protrudes at both ends thereof, preferably by about 4 mm.

Once the bar 15 is in position, a clearance hole or aperture is provided through the top of the glazing panel 10, followed by a tapping hole through the reinforcement bar 15. Such an aperture is preferably provided on both sides of the glazing panel 10 in a central position. Fixing means 32, such as a self-tapping screw, is then driven into a surface of the glazing panel 10 and reinforcement bar 15 until an end of same protrudes through reinforcement bar 15 into space 38 provided by base member 35 of the glazing bar 30.

If applicable, U-profile capping members can then be placed on either end of the glazing panel 10. The protrusion of the reinforcement bar 15 beyond the end of the panel 10 is intended to act as a restraint by contacting the U-profile capping members, thus preventing any sideways movement of the reinforcement bar 15.

Figure 7:
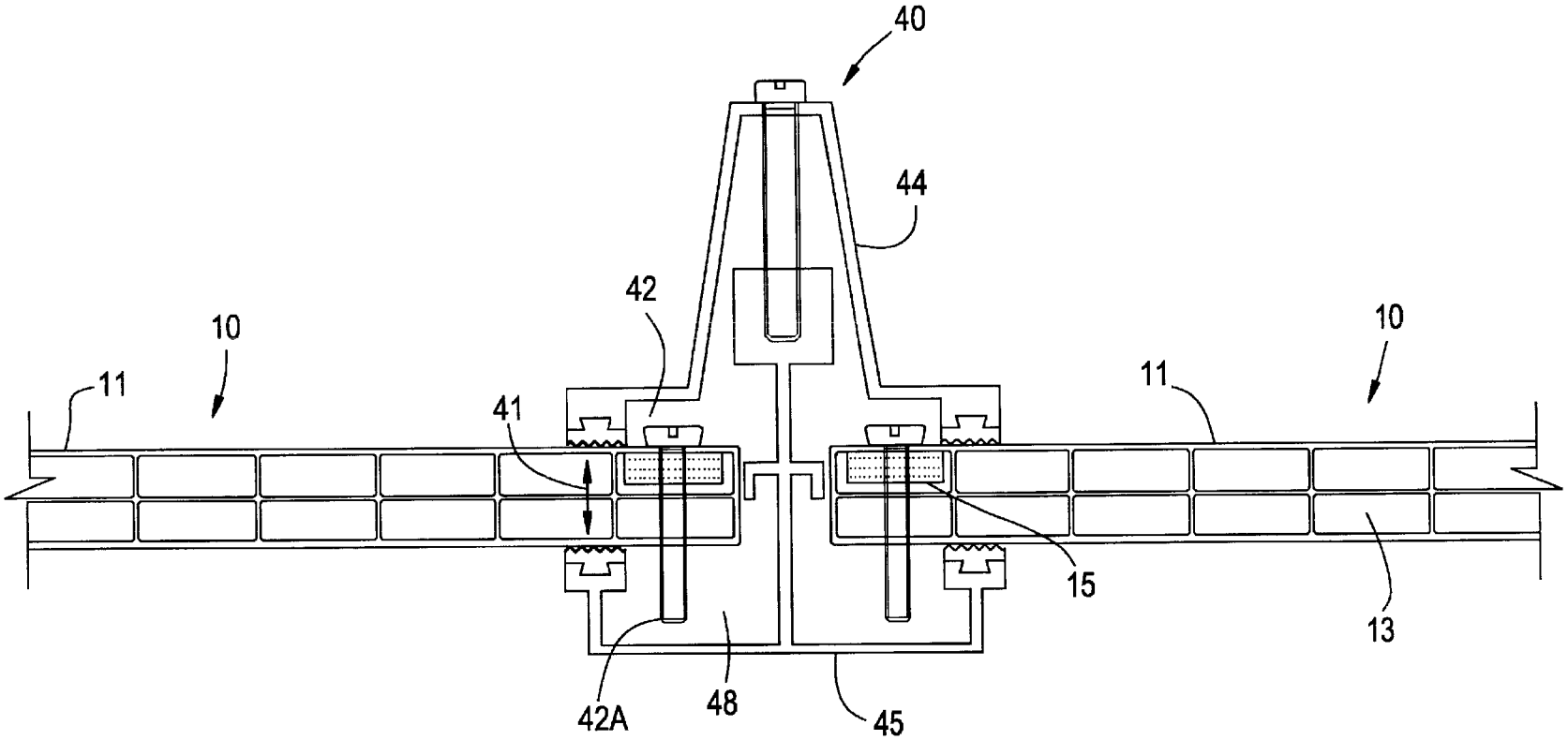
FIG. 7 is a cross-sectional view of a multi-walled glazing panel of FIG. 2 when attached to a second embodiment of a "conventional" type glazing bar.

As illustrated in FIG. 7, each side of the panel 10 is locatable between the jaw or clamp portion 41 provided by a base member 45 and a capping bar 44 of a glazing bar 40. As shown, the panel 10 and reinforcement bar 15 are fixed to one another via fixing means 42, such as a self-tapping screw. As illustrated, one end 42*a* of fixing means 42 protrude into space 48 provided by base member 45 of the glazing bar 40. As the fixing means 42 protrude into the space 48, when the glazing panel 10 is hit by an object, this causes the end 42*a* of the fixing means 42 to engage with a surface of the base member 35 and hence, prevents the glazing panel 10 from being removed or dislodged from the clamp member 31 provided by the base member 45 and capping member 44.

Additionally, the reinforcement bar 15 is located within the confines of the jaw 41 provided by the base member 45 and capping bar 44 of the glazing bar 40 and hence, is concealed. As illustrated, once fixed to the glazing bar 40, each end of the glazing panel 10 can be provided with a U-profile capping member.

In order to attach a multi-walled polycarbonate glazing panel 10 in accordance with the present invention to a glazing bar 40 as shown in FIG. 7, a reinforcement bar 15 is inserted into channels 13 at each side of the panel 10. It is preferable, that the lengths of the reinforcement bar 15 is selected such that when located within the glazing panel 10, same protrudes at both ends thereof, preferably by about 4 mm.

Once the bar 15 is in position, a clearance hole or aperture is provided through the top of the glazing panel 10, followed by a tapping hole through the reinforcement bar 15. Such an aperture is prefarably provided on both sides of the glazing panel 10 in a central position. Fixing means 42, such as a self-tapping screw, is then driven into a surface of the glazing panel 10 and reinforcement bar 15, until an end of same protrudes through reinforcement bar 15 until same protrudes through the other side of the glazing panel 10.

The panel is then located on to the base member 45 such that the lower end 42*a* of the fixing means 32 is located in the space 48 provided thereby and the capping member 44 of the glazing bar 40 is then placed on top of the panel 10 such that the jaws 41 provided by the glazing bar 40 clamps the panel 10 in position.

If applicable, U-profile capping members can then be placed at either end of the glazing panel 10. The protrusion of the reinforcement bar 15 beyond the end of the panel 10 is intended to act as a restraint by contacting the U-profile capping members, thus preventing any sideway movements of the reinforcement bar.

Figure 8:
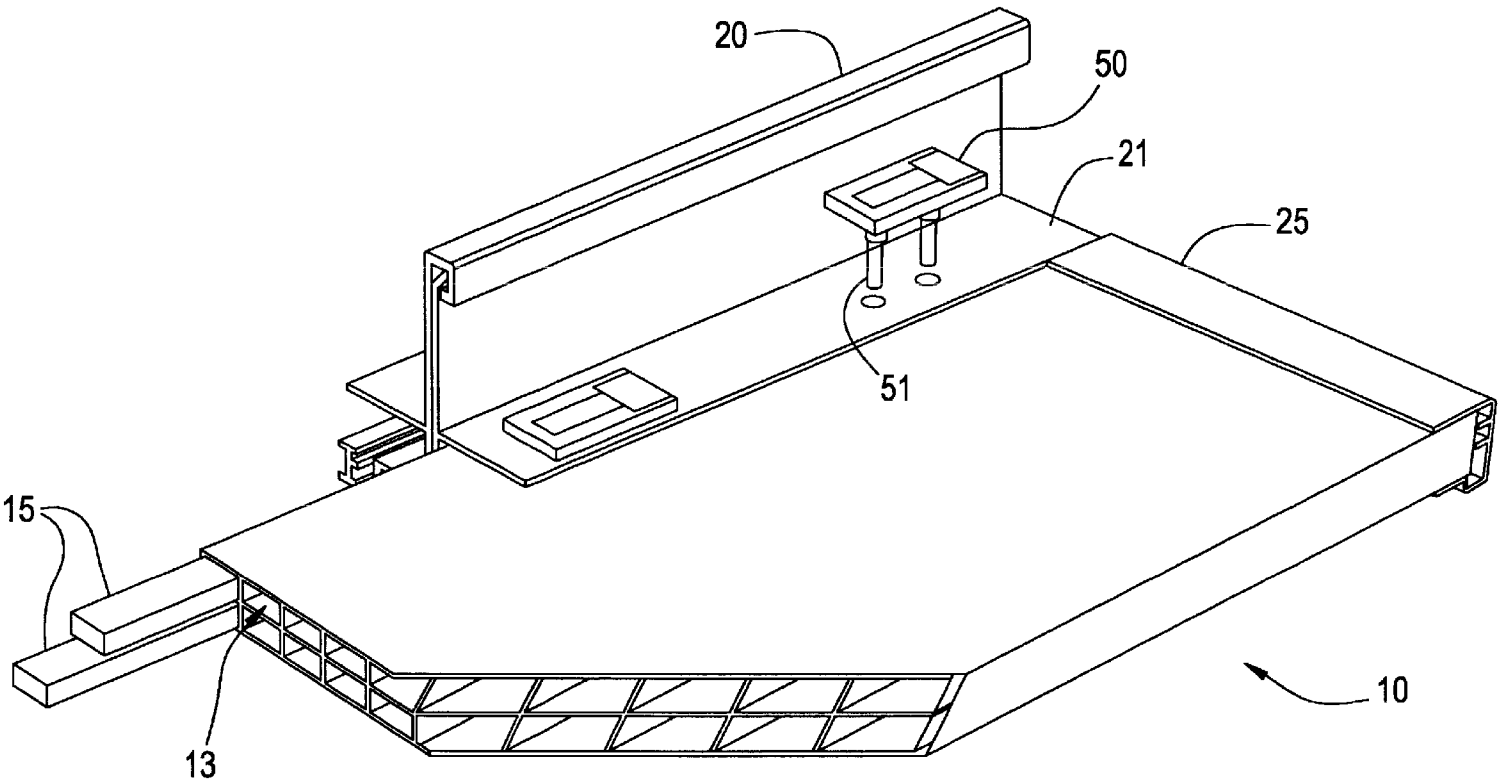
FIG. 8 is a perspective view of a second embodiment of a multi-walled glazing panel in accordance with the present invention.

As illustrated in FIG. 8, each channel 13 located on either side of the multi-walled glazing panel 10 is provided with a reinforcement bar 15. It will be appreciated that by increasing the number of reinforcement bars 15, the reinforcement of the glazing panel 10 is increased such that same is less likely to become dislodged from the glazing bars 20 to which it is attached, that is, in the event that a heavy object falls onto same. In the illustrated embodiment, the two channels 13 directly adjacent the glazing bar 20 are each provided with a reinforcement bar 15. It is to be understood that the number of reinforcement bars 15 utilized can vary depending on the number of channels 13 provided within the multi-walled glazing panels 10 which are located at either side of the multi-walled glazing panel 10, for example, a multi-walled glazing panel 10 which includes four horizontal sheet members 11 will have three channels 13 at either side thereof and consequently, each side of such a multi-walled glazing panel 10 can be provided with three reinforcement bars 15.

Figure 9:
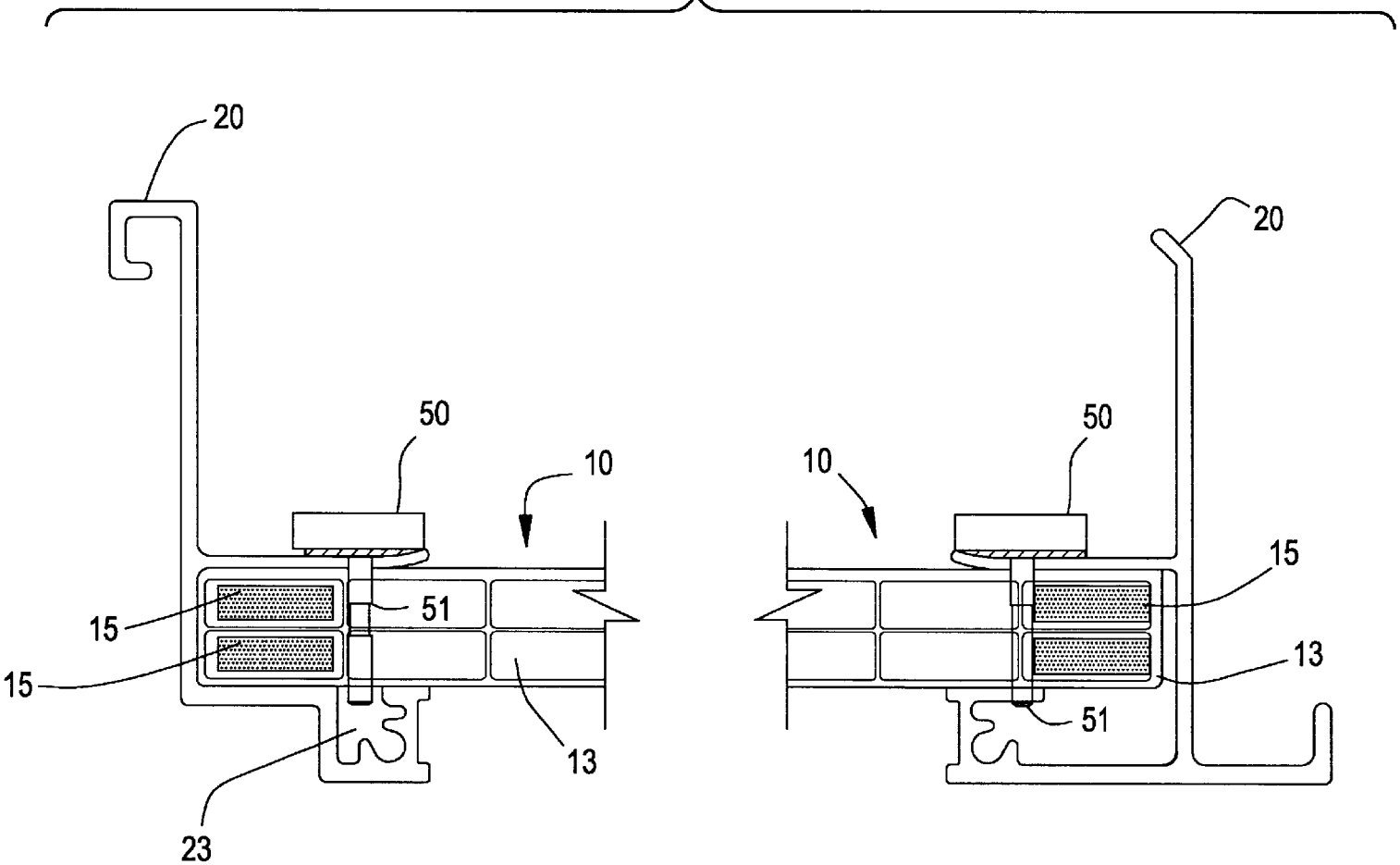
FIG. 9 is a cross-sectional view of the multi-walled glazing panel of FIG. 8 when attached to the glazing bar of FIG. 3.

As illustrated in FIGS. 8 and 9, the reinforcement bars 15 are not fixed to the glazing bar 20 via fixing means 22, for example, a self tapping screw, but rather are held, or retained, in position by a stop member 50. As illustrated, each side of the multi-walled glazing panel 10 is provided with two stop members 50; however, it is to be understood that the number can vary depending on the length of the multi-walled glazing panel 10 and support required. Preferably, each stop member 50 includes a plurality of downwardly extending legs 51 which, in use, are located adjacent the reinforcement bars 15 (see FIG. 9). Depending on the width of the reinforcement bars 15 and the width of the channels 13, it is to be understood that the legs 51 may be inserted into the same channel 13 within which the reinforcement bar 15 is located, or in an adjacent channel 13. Preferably, the legs 51 of the stop member 50 are long enough so that they extend into space 23 provided by glazing panel 20, such that on impact the lower portions of the legs 51 will interact or engage with the glazing bar 20 and hence, assists with preventing the multi-walled glazing panel 10 from being removed or dislodged from the glazing bar 20, that is, in the event that an object falls onto same.

In order to install a multi-walled polycarbonate glazing panel 10 as shown in FIG. 8, a reinforcement bar 15 is inserted into each channel 13 located at either side of the multi-walled glazing panel 10. It is preferable that the length of the reinforcement bar 15 is selected such that when located within the glazing panel 10, same protrudes at both ends thereof, preferably by about 4 mm.

Once the bars 15 are in position, a plurality of suitably spaced clearance holes or apertures are provided through the top of each jaw 21 and through the glazing panel 10 such that the legs 51 of stop member 50 can be inserted through the jaw 21 of the glazing bar 20 and through the multi-walled glazing panel 10 located therein.

If applicable, U-profile capping members 25 are then placed at either end of the glazing panel 10. The protrusion of the reinforcement bar 15 beyond the end of the panel 10 is intended to act as a restraint by contact with the U-profile capping members 25, thereby preventing any sideways movement of the reinforcement bars 15.

Although the present invention has been described by way of example to a multi-walled glazing panel made of polycarbonate it is to be understood that same can be made of any other similar material of like properties.

It is to be understood that the sides portions, which are attachable to a support structure, of a multi-walled glazing panel in accordance with the present invention can be constructed from a solid material integral with the multi-walled glazing panel. For example, the channels located within the side portion which is attachable to the support structure may be filled with a solid, settable material; the material having the desired rigidity.

It is to be understood that a multi-walled glazing panel in accordance with the present invention may have more than one reinforcement bar located in adjacent channels in each side portion of the multi-walled glazing panel which is to be attached to, or supported by, a support structure.

It is to be understood that a multi-walled glazing panel in accordance with the present invention can be located on any part of a building or other structure.

Whilst the foregoing description includes many details and specificities, these are included for purposes of explanation only and are not to be interpreted as limitations of the invention. Many modifications will be readily apparent to those of ordinary skill in the art which do not depart from the spirit and scope of the invention, as defined by the following claims and their legal equivalents.

I claim:

1. A multi-walled glazing panel constructed and arranged for attachment at a side thereof to a support structure, the multi-walled glazing panel including a plurality of horizontal sheet members separated from one another by vertical interconnecting walls, said vertical interconnecting walls defining channels running lengthwise along the multi-walled glazing panel, the multi-walled glazing panel further comprising a reinforcement means disposed in at least one channel adjacent a side at which the panel is constructed and arranged for attachment to a support structure to reinforce said side, and at least one protruding member disposed at either side thereof constructed and arranged to engage with a surface of the support structure.

2. A multi-walled glazing panel as claimed in claim 1, in which the reinforcement means is insertable into said at least one channel.

3. A multi-walled glazing panel as claimed in claim 2, in which the reinforcement means is insertable into at least one of the channels located directly adjacent the side.

4. A multi-walled glazing panel as claimed in claim 3, wherein each channel located directly adjacent the side is provided with reinforcement means.

5. A multi-walled glazing panel as claimed in claim 1, in which the reinforcement means comprise a bar of rigid material.

6. A multi-walled glazing panel as claimed in claim 5, in which the bar of rigid material is made from metal or polycarbonate.

7. A multi-walled glazing panel as claimed in claim 2, in which the reinforcement means is sized to fill the at least one channel within which it is disposed, and to be readily removable therefrom.

8. A multi-walled glazing panel as claimed in claim 1, in which the reinforcement means has a length sufficient to protrude from either end of the at least one channel.

9. A multi-walled glazing panel as claimed in claim 1, in which the protruding member comprises at least one screw protruding from the reinforced side of the multi-walled glazing panel.

10. A multi-walled glazing panel as claimed in claim 1, in which the protruding member includes at least one stop member which, in use, is locatable adjacent the reinforced side.

11. A multi-walled glazing panel as claimed in claim 10, in which the stop member includes at least two legs.

12. A multi-walled glazing panel as claimed in claim 1, in which the reinforced side is sized to be concealed by a portion of the support structure.

13. A method of attaching the sides of a multi-walled glazing panel which includes a plurality of horizontal sheet members separated from one another by vertical interconnecting walls, said vertical interconnecting walls defining channels running lengthwise along the multi-walled glazing panel, the method comprising the steps of:

providing the multi-walled glazing panel with at least one protruding member engageable with a surface of the support structure;

inserting at least one reinforcement means into at least one channel located at a side of the multi-walled glazing panel; and attaching the multi-walled glazing panel to a support structure.

14. A multi-walled glazing panel as claimed in claim 1, in which opposite sides of the panel are reinforced.

15. In combination, a support structure for a multi-walled glazing panel; and a multi-walled glazing panel attached at a side thereof to the support structure, the multi-walled glazing panel including a plurality of horizontal sheet members separated from one another by vertical interconnecting walls, said vertical interconnecting walls defining channels running lengthwise along the multi-walled glazing panel, the multi-walled glazing panel further comprising a reinforcement means disposed in at least one channel adjacent a side at which the panel is attached to the support structure, and at least one protruding member disposed at either side thereof which engages with a surface of the support structure.

16. The combination of claim 15, in which the protruding member comprises at least one screw protruding from a side of the multi-walled glazing panel attached to the support structure.

17. The combination of claim 15, in which the protruding member includes at least one stop member which is located adjacent a side attached to the support structure.

* * * * *